US007922495B2

(12) United States Patent
Masuda

(10) Patent No.: US 7,922,495 B2
(45) Date of Patent: Apr. 12, 2011

(54) ZERO INSERTION FORCE CARD EDGE CONNECTOR

(75) Inventor: Yasushi Masuda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 81 days.

(21) Appl. No.: 12/314,919

(22) Filed: Dec. 18, 2008

(65) Prior Publication Data

US 2009/0258515 A1 Oct. 15, 2009

(30) Foreign Application Priority Data

Apr. 15, 2008 (JP) ..... 2008-106145

(51) Int. Cl.
*H01R 12/00* (2006.01)

(52) U.S. Cl. ..... 439/59; 439/636

(58) Field of Classification Search ..... 439/59, 439/62, 636, 637
See application file for complete search history.

(56) References Cited

U.S. PATENT DOCUMENTS

| | | | | |
|---|---|---|---|---|
| 4,894,022 | A | 1/1990 | Guckenheimer | |
| 5,051,099 | A * | 9/1991 | Pickles et al. | 439/108 |
| 6,618,942 | B2 * | 9/2003 | Beaman et al. | 29/854 |
| 6,918,778 | B2 | 7/2005 | Ruckerbauer et al. | |
| 7,267,580 | B2 * | 9/2007 | Huang et al. | 439/637 |
| 7,390,208 | B1 * | 6/2008 | Sabo | 439/267 |

FOREIGN PATENT DOCUMENTS

| | | |
|---|---|---|
| JP | 48-012552 | 2/1973 |
| JP | 04-049488 | 4/1992 |
| JP | 08-273761 | 10/1996 |
| JP | 2002-110276 | 4/2002 |
| JP | 2003-031301 | 1/2003 |
| JP | 3790450 | 6/2006 |

OTHER PUBLICATIONS

Chinese Office Action for corresponding Chinese Application 200910009602.2; issued Dec. 14, 2010.

* cited by examiner

*Primary Examiner* — Edwin A. Leon
*Assistant Examiner* — Vanessa Girardi
(74) *Attorney, Agent, or Firm* — Staas & Halsey LLP

(57) ABSTRACT

A connector includes a first connection member and a second connection member that come in electrical contact with terminal units of a board module. The first and second connection members have connection bodies with connection terminal units formed thereon, and press members that at the time of setting the board module, cause the connection terminals of the connection bodies to deform toward the terminal units of the board module and come in contact with the terminal units when the press members comes in contact with the leading edge of the board module.

4 Claims, 9 Drawing Sheets

ZERO INSERTION FORCE CARD EDGE CONNECTOR

CROSS-REFERENCE TO RELATED APPLICATIONS

This application is based upon and claims the benefit of priority of the prior Japanese Patent Application No. 2008-106145, filed on Apr. 15, 2008, the entire contents of which are incorporated herein by reference.

BACKGROUND

1. Field

The present invention relates to a connector that electrically connects a printed wiring board (board module) used in electric equipment, etc., and more particularly, to a connector capable of preventing a contact failure between a contact terminal of a board module and a contact member of a connector and of improving the reliability of a connector for a long period.

2. Description of the Related Art

Conventionally, when a board module carrying a semiconductor component, etc., is connected electrically, a card edge connector, etc., having a contact member connected freely to a contact terminal of the board module has been used.

The structure of a conventional connector 1' will be described referring to FIG. 9. FIG. 9 is a general configuration diagram of the interior of the conventional connector 1'. As shown in FIG. 9, the connector 1' includes a body 4 having a first erected unit 2 and a second erected unit 3 that are erected in forked arrangement. Inside the first and second erected units 2 and 3, a pair of contact members (connection terminals 4 and 5) is disposed.

As shown in FIG. 9, the connection terminals 4 and 5 inside the first and second erected units 2 and 3 are disposed to be opposite to each other across a given gap. As shown in FIG. 10, when a board module 8 is inserted and set in the connector 1', contact terminals (terminal units 9 and 9) disposed on the side faces of the board module 8 come in contact with terminal units 4*a* and 5*a* of the contact members (connection terminals 4 and 5), respectively, to establish an electrical connection.

Japanese Patent Application Laid-open Publication No. 2002-110276 discloses a conventional technique related to the terminal structure described above. The above conventional technique is disclosed as a terminal structure in which a tongue piece of a curved shape is disposed on a female terminal unit to prevent a decrease in cramping pressure when the female terminal unit comes in contact with a male terminal unit and facilitate insertion of the male terminal unit into the female terminal unit.

Japanese Utility Model Application Laid-open Publication No. 48-012552 discloses a connector such that a male connector has a guide pin while a female connector has an insertion unit opening and closing in response to insertion of the guide pin so that frictional resistance resulting at the time of inserting the male connector into the female connector is reduced.

The above conventional connectors, however, pose the following problems. According to the conventional connectors, when the board module 8 is inserted in an inlet of the connector 1', the terminals units 9 and 9 of the board module 8 come in contact with the terminal units 4*a* and 5*a* of the connector 1'.

This contact is made by exerting a strong press force that pushes the board module 8 into the inlet against an elastic force of the connection terminals 4 and 5 of the connector 1' to push the connection terminals 4 and 5 outward (arrowed direction). As a result, the edge of the board module 8 is scraped in many cases. In some cases, the terminal units 4*a* and 5*a* of the connector 1' are scraped in friction to produce scrapings when made of a soft material.

If such scrapings are caught in between the terminal units 9 and 9 of the board module 8 and the terminal units 4*a* and 5*a* of the connector 1', an electrical contact failure may happen.

When the contact members (connection terminals 4 and 5) of the connector 1' are made of a soft material, in particular, the terminal units 9 and 9 of the board module 8 cut deeply in the contact member (connection terminals 4 and 5), thus heavily scraping the surface of the connection terminals 4 and 5. As a result, scrapings are produced more frequently to bring the cause of an electrical contact failure.

In a case of conventional connector-related structures disclosed in publication of patent applications, a connection terminal of a connector may be soiled due to frequent use or deterioration by aging, or scrapings may be produced between contact faces as a result of strong contact between the contact faces. These structures, therefore, also pose a problem of the occurrence of such a trouble as contact failure.

SUMMARY

It is an object of the present invention to at least partially solve the problems in the conventional technology.

According to an aspect of an embodiment, a connector includes a contact member configured to be electrically connected to a contact terminal disposed on a side face of a board module when the board module is inserted. The contact member includes a first connection member having a first contact disposed at a position at which the first contact is pressed by a leading edge of the board module when the board module is inserted in an inlet provided on the connector; and a second connection member having a second contact that deforms elastically toward the contact terminal disposed on the side face of the board module to come in contact with the contact terminal when the leading edge of the board module presses the first connection member.

Additional objects and advantages of the invention (embodiment) will be set forth in part in the description which follows, and in part will be obvious from the description, or may be learned by practice of the invention. The object and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

DETAILED DESCRIPTION OF THE PREFERRED EMBODIMENTS

Figure 1:
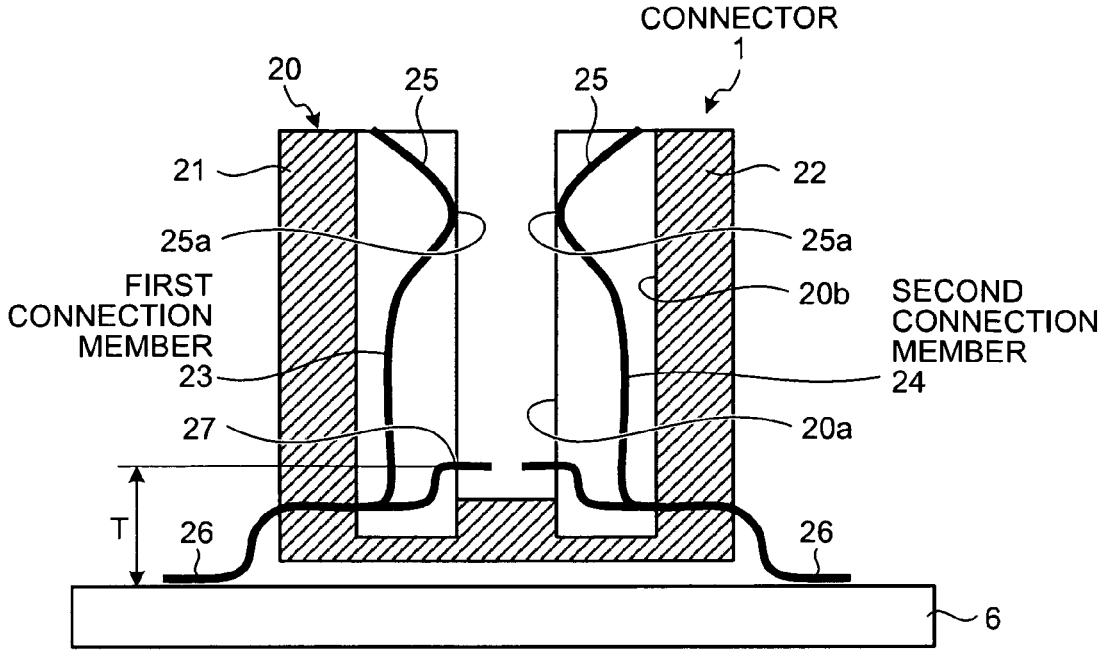
FIG. 1 is a general configuration diagram of the interior of a connector according to a first embodiment.
Figure 2:
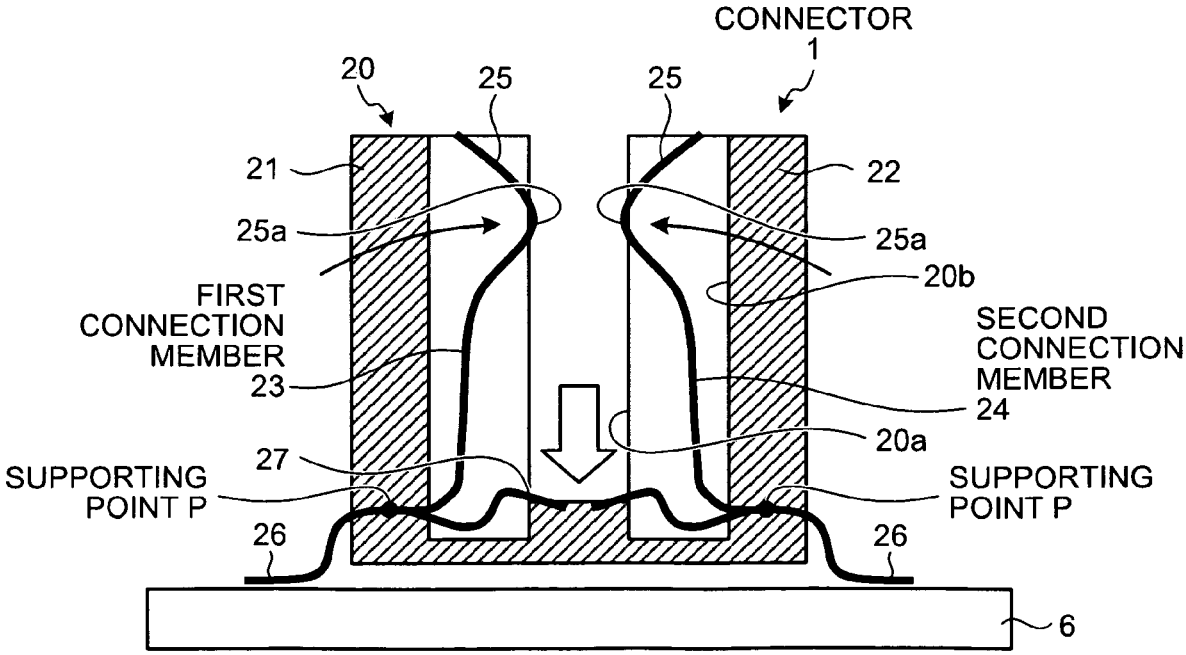
FIG. 2 is an explanatory view of the operation state of a first connection member and a second connection member.

Exemplary embodiments of structures of a connector 1 according to the present invention will now be described in detail with reference to the accompanying drawings. FIG. 1 is a general configuration diagram of the interior of the connector 1 according to a first embodiment. FIG. 2 is an explanatory view of the operation state of a first connection member 23 and a second connection member 24.

In the first embodiment, a general configuration and features of the connector 1 will be described, and the detail of operation state of the connector 1 will then be described. The first embodiment to be described does not limit the present invention.

As shown in FIG. 1, according to the connector 1 of the first embodiment, contact members (first connection member 23 and second connection member 24) of the connector 1 that come in electrical contact with terminal units 31 and 32 (see FIG. 3) of a board module 30 each include a connection body 25 having a connection terminal 25*a* formed thereon, and a press member 27 that causes the connection body 25 to deform elastically when coming in contact with a leading edge 33 of the board module 30.

When the board module 30 is inserted in the connector 1 (initial stage), the terminal units 31 and 32 of the board module 30 are brought into contact not strongly with the first and second connection members 23 and 24. Instead, when nearly the whole of the board module 30 is inserted in an inlet 20*a* (interior) of the connector 1, the connector 1 utilizes the elasticity of the first and second connection members 23 and 24 and of the press members 27 to prevent the first and second connection members 23 and 24 from coming in contact with the edges of the terminal units 31 and 32 of the board module 30. This is a feature of the connector 1.

As shown in FIG. 1, the connector 1 includes a body 20 having a first erected unit 21 and a second erected unit 22 that are erected in forked arrangement across a given gap. On the side of recessions 20*b* formed on the interior of the first and second erected units 21 and 22, the first connection member 23 and the second connection member 24 are disposed, which come in electrical contact with the terminal units 31 and 32 of the board module 30.

The first connection member 23 and the second connection member 24 have the inward U-shaped connection bodies 25 and 25 with the connection terminals 25*a* and 25*a*, and fitting units 26 and 26 that partly extend out of the body 20 of the connector 1 to be fitted and fixed to a board 6 in an exposed state.

On the lower parts of the connection bodies 25 and 25 of the first connection member 23 and the second connection member 24, the press members 27 and 27 are formed, which are extended inwardly in a U shape. The press members 27 and 27 have a function of causing the connection bodies 25 and 25 of the first connection member 23 and the second connection member 24 to deform elastically when the press member 27 and 27 come in contact with the leading edge 33 of the board module 30 at the time of insertion of the board module 30 in the connector 1.

As shown in FIG. 2, when a downward (arrowed direction) force is applied to the press members 27 and 27 of the first connection member 23 and the second connection member 24, the press members 27 and 27 cause the connection bodies 25 and 25 of the first and second connection members 23 and 24 to move out of the recessions 20*b*, utilizing the elasticity of the connection bodies 25 and 25. The press members 27 and 27 thus cause the connection bodies 25 and 25 to deform elastically toward the terminal units 31 and 32 of the board module 30 to bring the connection terminals 25*a* and 25*a* of the connection bodies 25 and 25 into contact with the terminal units 31 and 32 for electrical connection.

This prevents the scraping of the edge of the board module 30 or of a contact due to an excessive contact pressure between the contact terminals (terminal units 31 and 32) of the board module 30 and the contact members (first and second connection members 23 and 24) of the connector 1 and also prevents a contact failure caused by scrapings when the board module 30 is inserted.

Figure 3:
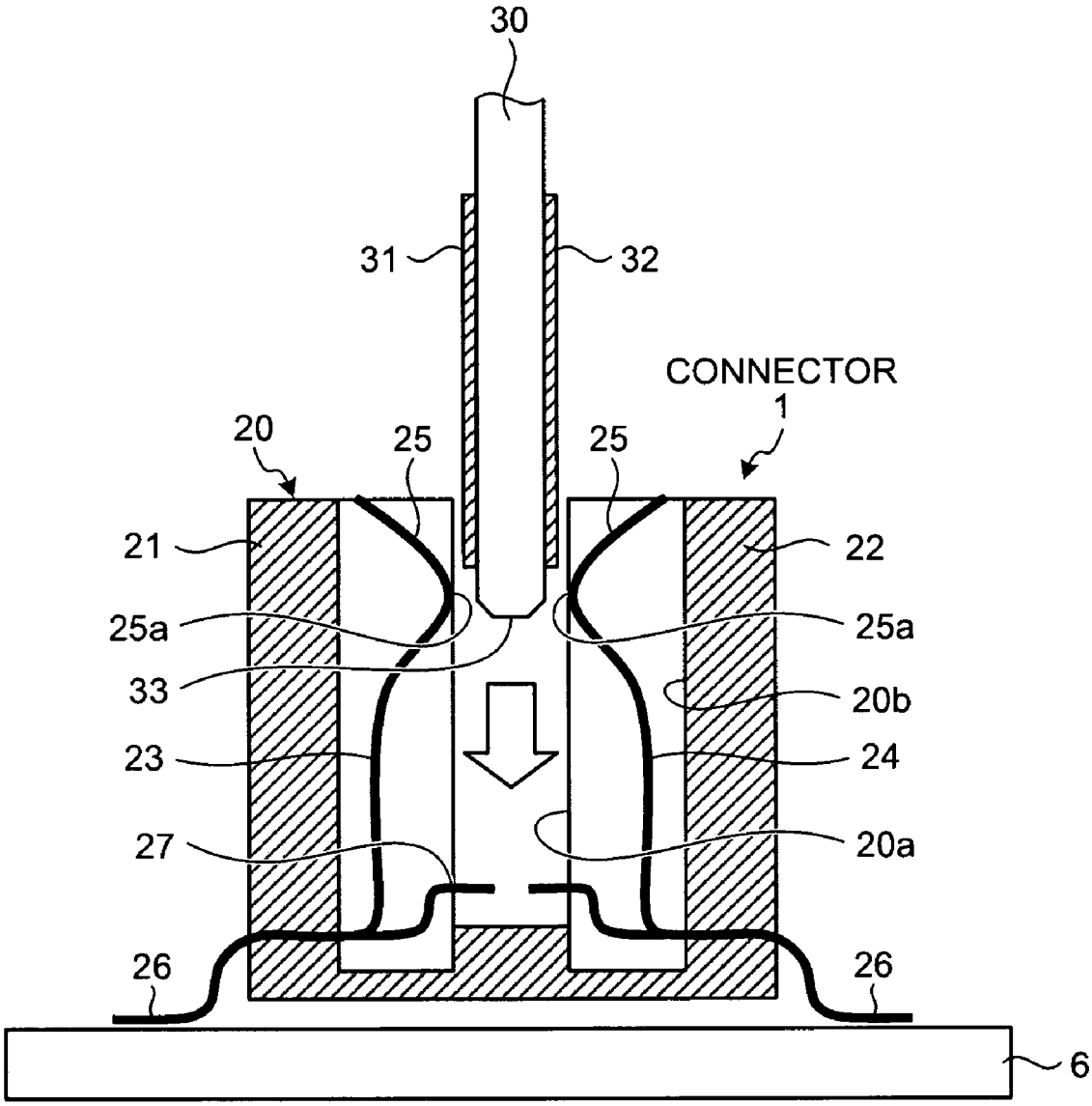
FIG. 3 is an explanatory view of the state of a board module before insertion of the board module into the connector.
Figure 4:
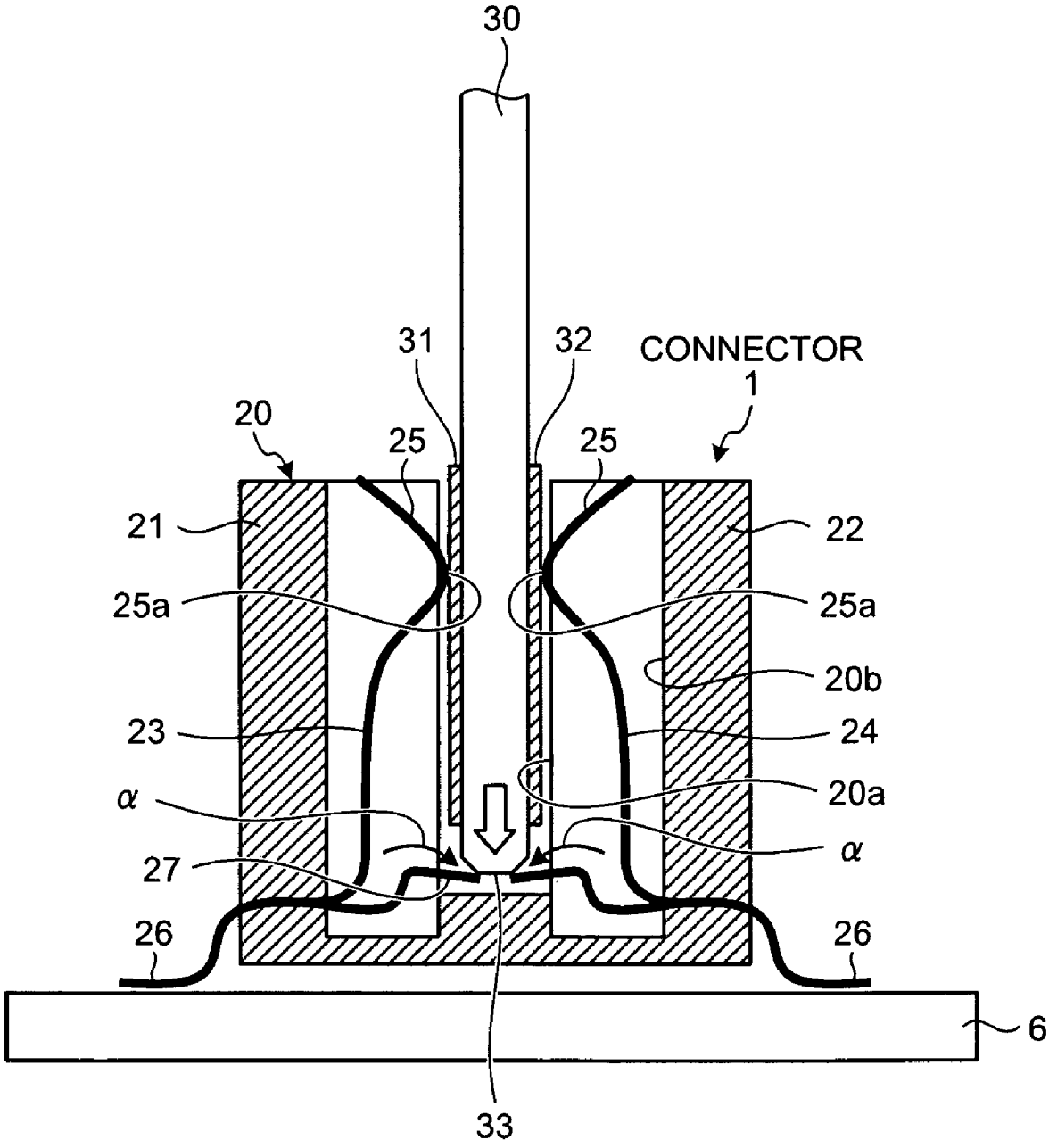
FIG. 4 is an explanatory view of the state of the board module that is in the course of insertion.

The operation state of the first connection member 23 and the second connection member 24 of the connector 1 will be described referring to FIGS. 3 to 5. FIG. 3 depicts the state of the board module 30 before insertion of the board module 30 into the connector 1. FIG. 4 depicts the state of the board module 30 that is in the course of insertion. Further, FIG. 5 depicts the state of the board module 30 that has been inserted completely.

As shown in FIG. 3, in the initial state where the board module 30 is inserted in the inlet 20*a* of the connector 1, the first connection member 23 and the second connection member 24 disposed in the connector 1 are positioned inside the recessions 20*b* and 20*b* of the first and second erected units 21 and 22. The connection terminals 25*a* and 25*a* of the first connection member 23 and the second connection member 24 in the initial state, therefore, do not come in contact with the edge of the board module 30.

When the board module 30 is inserted further (in a white arrowed direction) to bring the leading edge 33 of the board module 30 into contact with the upper surfaces of the press members 27 and press the press members 27 downward (in an $\alpha$ direction in FIG. 4), as shown in FIG. 4, the press members 27 and 27 deform elastically downward (in the $\alpha$ direction in FIG. 4). This causes the connection bodies 25 and 25 to shift in $\beta$ directions about supporting points (or fulcrums) P, respectively, as shown in FIG. 5. The connection bodies 25 and 25 then move inwardly out of the recessions 20*b* and 20*b*, at which the terminal units 31 and 32 of the board module 30 come in contact with the connection terminals 25*a* and 25*a* of the first connection member 23 and the second connection member 24, respectively. As a result, the board module 30 is connected electrically to the connector 1.

Figure 5:
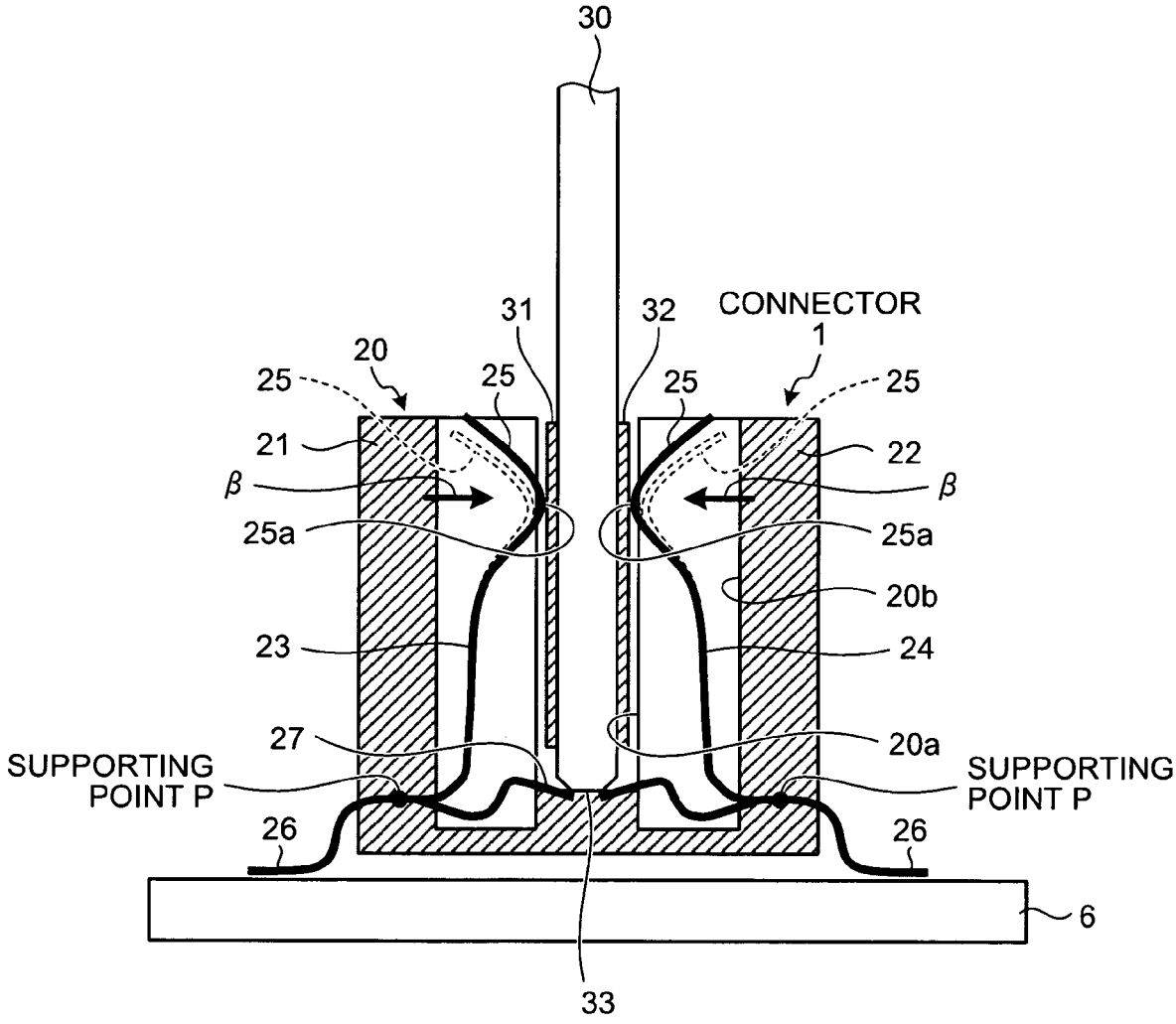
FIG. 5 is an explanatory view of the state of the board module that has been inserted completely.
Figure 10:
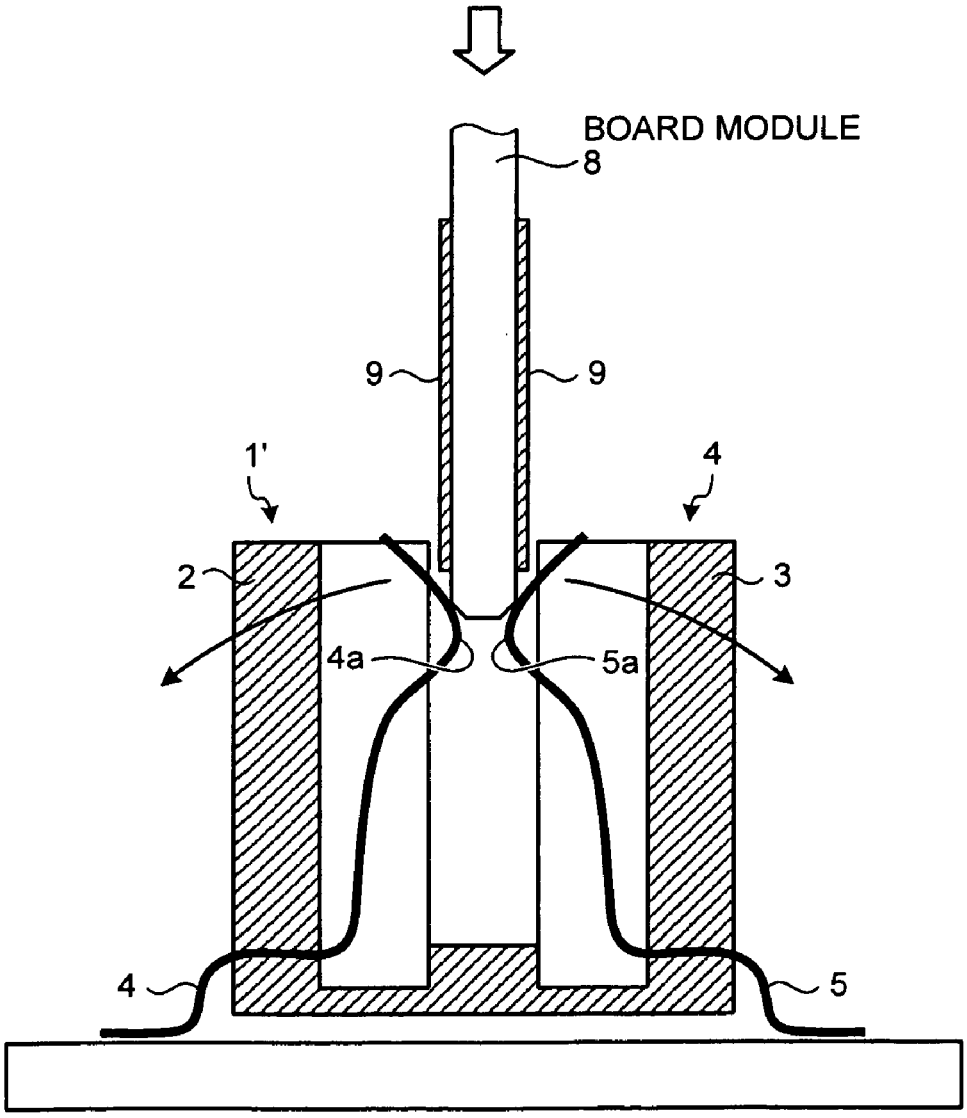
FIG.10 RELATED ART
FIG. 10 is an explanatory view of the state of a conventional board module that is in the course of insertion.

As shown in FIG. 5, the contact between the connection terminals 25*a* and 25*a* of the first connection member 23 and the second connection member 24 of the connector 1 and the terminal units 31 and 32 of the board module 30 is made to prevent an electrical contact failure, etc., which may happen as in the case of the structure of the conventional connector 1' (shown in FIG. 10) when pointed portions, such as the edge of the board module 30 or of a pad and a contact, come in contact with each other to produce scrapings and the scrapings are get caught in between contact surfaces.

As described above, according to the structure of the connector 1 of the first embodiment, the connector 1 includes the first connection member 23 and the second connection member 24 that come in electrical contact with the terminal units 31 and 32 of the board module 30, and these first and second connection members 23 and 24 have the connection bodies 25 and 25 with the connection terminals 25*a* and 25*a* formed thereon, and the press members 27 and 27 that cause the connection terminals 25*a* and 25*a* of the connection bodies 25 and 25 to deform elastically toward the terminal units 31 and 32 of the board module 30 when the leading edge 33 of the board module 30 comes in contact with the press members 27 and 27. This configuration prevents an electrical contact failure caused by the production of scrapings resulting from the contact between contact members (the first connection member 23 and the second connection member 24) of the connector 1 and the edge of the board module 30, the contact being made by insertion of the contact terminals (terminal units 31 and 32) of the board module 30, and by scrapings' coming in between the contact members when the board module 30 is inserted in the connector 1.

Even if the contact members (first and second connection members 23 and 24) of the connector 1 are made of a soft material, the contact members can be brought in electrical connection with the connection terminals or terminal units 31 and 32 of the board module 30 without strong interference with the connection terminals or terminal units 31 and 32. This allows the use of a contact member made of an inexpensive soft material, thus enabling cost reduction.

Figure 6:
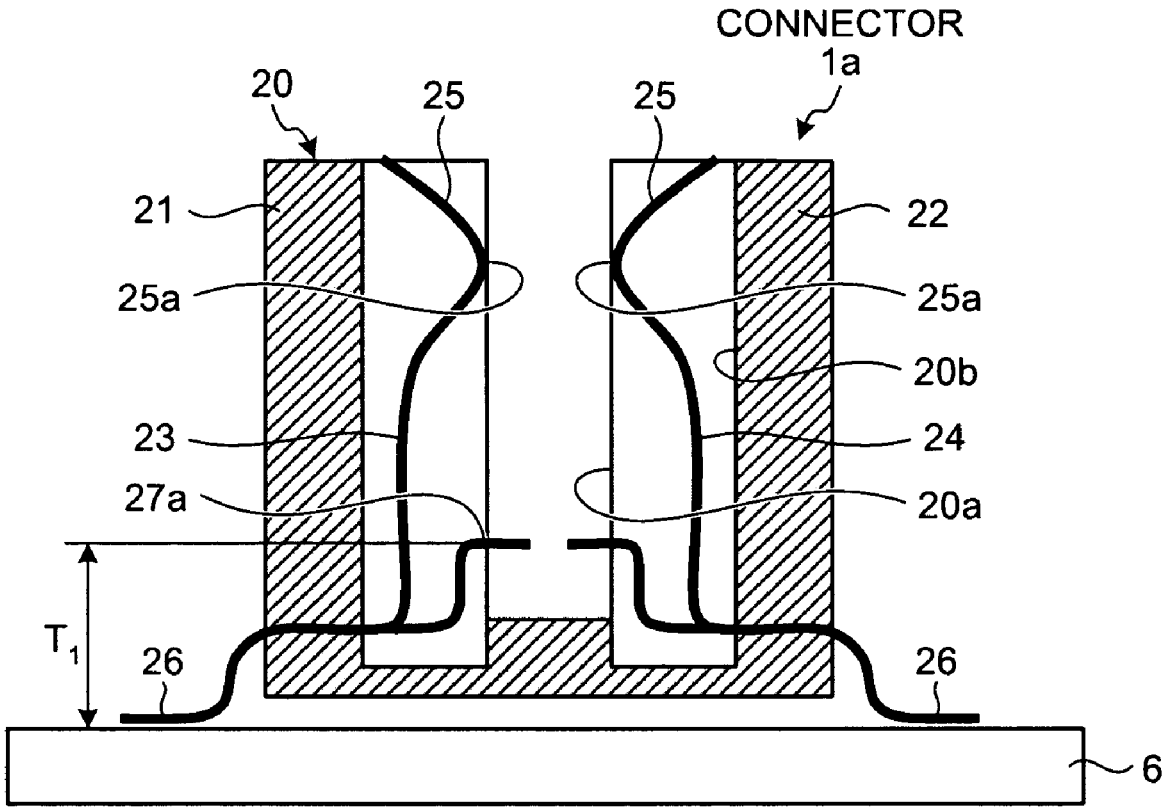
FIG. 6 is a general configuration diagram of the interior of a connector according to a second embodiment.

A second embodiment of a structure of a connector 1*a* of the present invention will then be described referring to FIG. 6. FIG. 6 is a general configuration diagram of the interior of the connector 1*a* according to the second embodiment.

The structure of the connector 1*a* of the second embodiment has a feature that the position of formation of press members 27*a* of the connector 1*a* is determined to be a given height $T_1$ in correspondence to a press by the leading edge 33 (FIG. 5) of the board module 30 and deformation start timing at which the connection bodies 25 start deforming in response to the press to the press members 27*a*.

Specifically, as shown in FIG. 6, the height of the press members 27*a* and 27*a* of the first connection member 23 and the second connection member 24 disposed in the connector 1*a* is determined to be a given preset value (height $T_1$) so that timing of a press to the press members 27*a* and 27*a* by the leading edge 33 of the board module 30 become earlier.

In the second embodiment, the height $T_1$ of the press members 27*a* is determined to be greater than the height T of the press members 27 of the connector 1 of the first embodiment shown in FIG. 1 (height $T_1$>height T). Because of this, in the case of the connector 1*a* of the second embodiment, the distance the leading edge 33 of the board module 30 takes to reach the upper surfaces of the press members 27*a* and depress the press members 27*a* is shorter than in the case of the connector 1 of the first embodiment.

This means that, in inserting (setting) the board module 30 in the connector 1*a*, the contact members (first connection member 23 and second connection member 24) of the connector 1*a* can be brought into contact with the contact terminals (terminal units 31 and 32) of the board module 30 in an early stage. This allows the connector 1*a* to reduce an insertion force of the board module 30, compared to the connector 1 of the first embodiment.

As described above, according to the structure of the connector 1*a* of the present invention, the position of the press members 27*a* of the connector 1*a* is determined to be the given height (height $T_1$) in correspondence to a press by the leading edge 33 of the board module 30 and deformation start timing at which the connection bodies 25 and 25 start deforming in response to the press to the press members 27*a*. If the position of the press members 27*a* is determined to be higher, therefore, the first and second connection members 23 and 24 can be brought into contact with the terminal units 31 and 32 of the board module 30 in a stage earlier than usual. This allows ensuring a longer wiping length of the board module 30 against the connector 1*a*.

Figure 7:
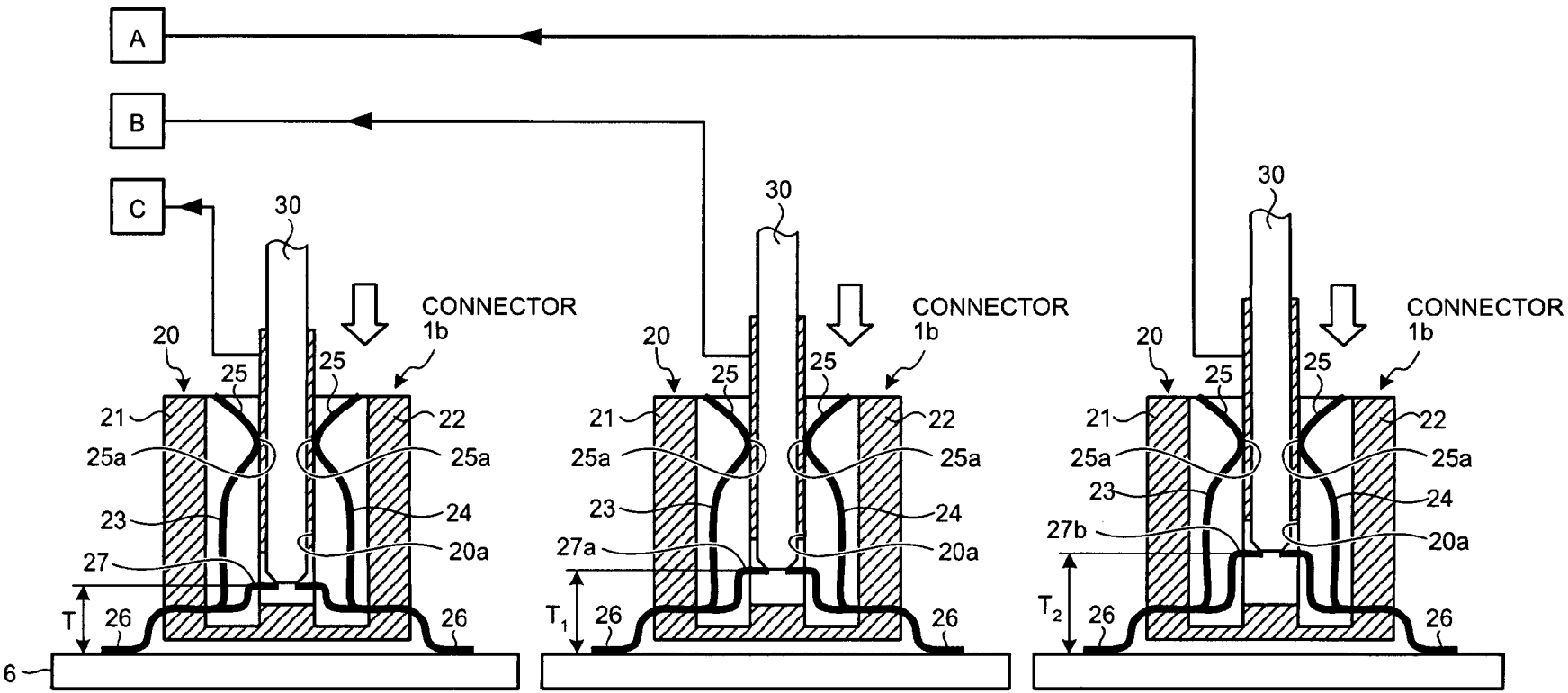
FIG. 7 is a general configuration diagram of the interior of a connector according to a third embodiment.

A third embodiment of a structure of a connector 1*b* of the present invention will then be described. FIG. 7 is a general configuration diagram of the interior of the connector 1*b* according to the third embodiment.

The connector 1*b* of the third embodiment has a feature that the positions of press members 27, 27*a*, and 27*b* having a plurality of the first connection members 23 and the second connection members 24 of the connector 1*b* are determined to be heights different from each other in correspondence to timing of electrical connection made by contact between a plurality of the connection terminals 25*a* and 25*a* of the first and second connection members 23 and 24 and the terminal units 31 and 32 of the board module 30.

Specifically, as shown in FIG. 7, among the press members 27, 27*a* and 27*b* of the plurality of first connection members 23 and second connection members 24 disposed in the connector 1*b*, the press members 27 are set at the height T, the press members 27*a* are set at the height $T_1$, and the press members 27*b* are set at the height $T_2$ so that the positions of the press members 27, 27*a*, and 27*b* are different from each other according to the determined heights (height T<height $T_1$<height $T_2$).

By the function of the press members 27, 27*a*, and 27*b* formed at three positions of different heights, the connection terminals 25*a* and 25*a* of the first and second connection members 23 and 24 having the press members 27*b* and 27*b* formed thereon come in contact first with the terminal units 31 and 32 of the board module 30, so that a conduction line A among a plurality of conduction lines A to C (at three spots) as shown in FIG. 7 can be determined to be the line that is energized first.

The first and second connection members 23 and 24 having the press members 27*a* and 27*a* formed thereon come in contact second with the terminal units 31 and 32 of the board module 30, so that the conduction line B among the conduction lines A to C can be determined to be the line that is energized second.

The first and second connection members 23 and 24 having the press members 27 and 27 formed thereon come in contact last with the terminal units 31 and 32 of the board module 30, so that the conduction line C among the conduction lines A to C can be determined to be the line that is energized last.

As described above, according to the structure of the connector 1*b* of the present invention, the operational positions of the plurality of press members 27, 27*a*, and 27*b* of the connector 1*b* are determined to be heights different from each other in correspondence to timing of electrical connection made by contact between the first and second connection members 23 and 24 and the terminal units 31 and 32 of the board module 30. This enables proper setting of priority in the order of energization of the plurality of conduction lines A to C.

Figure 8:
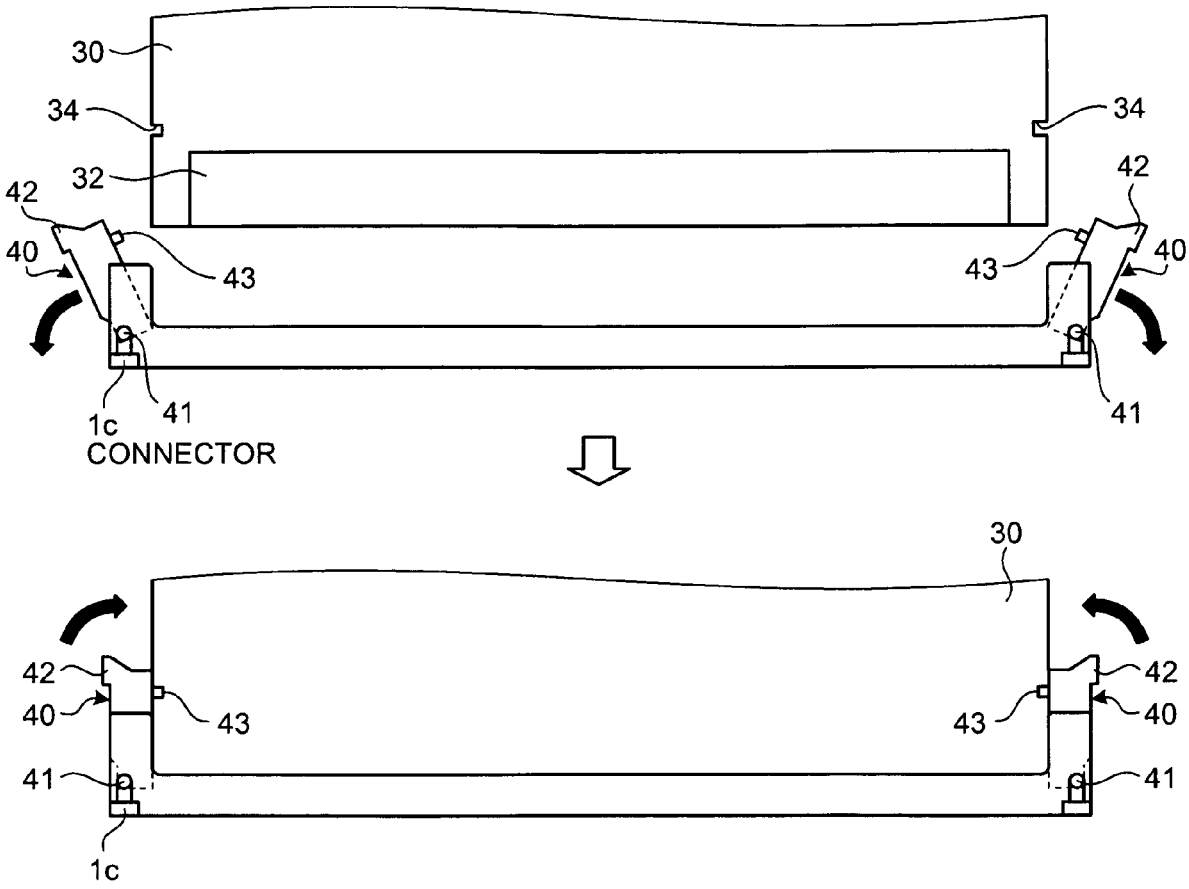
FIG. 8 is a figure to explain gripping mechanisms.
Figure 9:
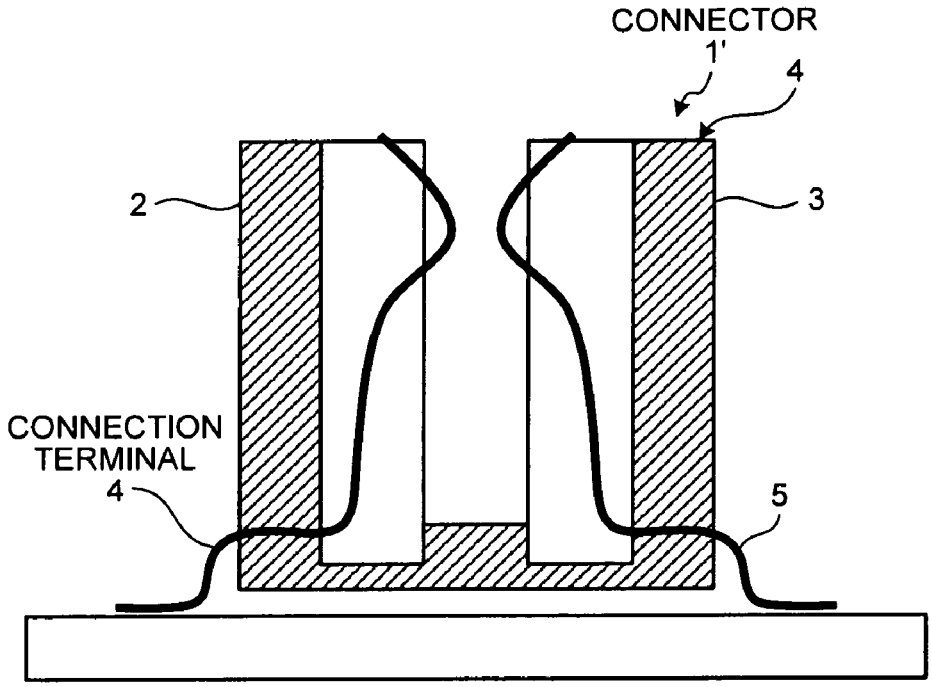
FIG.9 RELATED ART
FIG. 9 is a general configuration diagram of the interior of a conventional connector.

As shown in FIG. 8, the connector 1*c* includes gripping mechanisms 40 that when the board module 30 is inserted, grip both side ends of the board module 30 from both sides. The gripping mechanisms 40 grip the board module 30 inserted and set in the connector 1 c to support the board module 30 stationarily from both sides.

Specifically, the gripping mechanisms 40 have press support units 42 that cramp and fix both side ends of the board module 30 inserted in the connector 1*c* from both sides. The press support units 42 are turned manually around pivots 41 to fit fitting projections 43 formed on the interior of the press support units 42 into holes 34 formed on the side edges of the board module 30. In this manner, the connector 1*c* grips the board module 30 to fix it inside the connector 1*c*.

As described above, according to the structure of the connector 1*c*, when the board module 30 is inserted, the press support units 42 of the gripping mechanisms 40 grip both side ends of the board module 30 and the fitting projections 43 formed on the interior of the press support units 42 are fitted into the holes 34 formed on the side edges of the board module 30, so that the connector 1*c* grips the board module 30 to fix it inside the connector 1*c*. This prevents the board module 30 inserted and fixed in the connector 1*c* from unexpectedly slipping off or jumping out.

The present invention may be implemented in various embodiments other than the above embodiments within the scope of technical concepts described in the claims.

The connectors are described as card edge connectors to which the present invention applies. The present invention, however, also applies to an ordinary connector or pin- shaped connector having a structure similar to that of the above connector.

The connector disclosed in this description is able to prevent the production of scrapings resulting from strong contact between a contact member of a connector and a contact terminal of a board module and also prevent an electrical contact failure between the contact terminal of the board module and the contact member of the connector that is caused by scrapings coming in between the contact terminal and the contact member when the substrate module is inserted in the connector.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present invention(s) has(have) been described in detail, it should be understood that the various changes, substitutions, and alterations could be made hereto without departing from the spirit and scope of the invention.

What is claimed is:

1. A connector comprising:

a contact member configured to be electrically connected to a contact terminal disposed on a side face of a board module when the board module is inserted, wherein the contact member comprises a pair of connection members each fixedly attached to a substrate and each of single-piece construction having a first portion from which a connection terminal is formed, and having a second portion from which a press member is formed which causes the paired connection members to elastically deform toward the contact terminal bringing the connection terminals into contact with the contact terminal when a leading edge of the board module presses the press member.

2. The connector according to claim 1, wherein a position of the press member is determined to be a given height in correspondence to a press by the leading edge of the board module and deformation start timing at which the pair of connection members start deforming elastically in response to the press.

3. The connector according to claim 1, wherein positions of the press member are determined to be heights different from each other in correspondence to timing of electrical contact made between a plurality of the contact terminals disposed on the side surface of the board module and a plurality of the pair of connection members disposed in the connector.

4. The connector according to claim 1, further comprising:

a gripping unit disposed on both side ends of the connector and gripping both sides of the board module when the board module is inserted.

* * * * *